US011457686B1

(12) United States Patent
Haynes

(10) Patent No.: US 11,457,686 B1
(45) Date of Patent: Oct. 4, 2022

(54) HEEL STRAP

(71) Applicant: Patricia Ann Haynes, Temple, TX (US)

(72) Inventor: Patricia Ann Haynes, Temple, TX (US)

( * ) Notice: Subject to any disclaimer, the term of this patent is extended or adjusted under 35 U.S.C. 154(b) by 12 days.

(21) Appl. No.: 17/171,326

(22) Filed: Feb. 9, 2021

(51) Int. Cl.
*A43B 3/12* (2006.01)
*A43B 3/26* (2006.01)

(52) U.S. Cl.
CPC ..... *A43B 3/122* (2013.01); *A43B 3/26* (2013.01)

(58) Field of Classification Search
CPC ..... A43B 3/12; A43B 3/122; A43B 3/126; A43B 23/24
USPC ..... 36/11.5
See application file for complete search history.

(56) References Cited

U.S. PATENT DOCUMENTS 1,877,724 A * 9/1932 Gustin ..... A43B 3/12 36/105
2,177,571 A * 10/1939 Kirke ..... A43B 3/128 D2/916
2,590,648 A * 3/1952 Pitz ..... A43B 13/141 36/31
4,461,102 A * 7/1984 DeVincentis ..... A43B 3/122 36/15
8,381,415 B1 * 2/2013 Lanoue ..... A43B 3/126 36/11.5
8,539,695 B1 * 9/2013 Gemmen ..... A43B 3/16 36/7.1 R
2003/0009909 A1 * 1/2003 Chen ..... A43B 13/14 36/141
2007/0113387 A1 * 5/2007 Gerhardt ..... A43B 3/126 24/712
2008/0276492 A1 * 11/2008 Burnett ..... A43C 11/22 36/51
2009/0249650 A1 * 10/2009 Sarantakos ..... A43B 3/0078 36/11.5
2013/0326907 A1 * 12/2013 Ahanotu ..... A43B 3/126 36/58.6
2015/0047228 A1 * 2/2015 Pernia ..... A43C 11/1493 36/100
2016/0007673 A1 * 1/2016 McDonald ..... H01L 29/78 36/11.5
2016/0015117 A1 * 1/2016 Kizer ..... A43B 3/126 36/11.5
2019/0328078 A1 * 10/2019 Gray ..... A43B 3/122
2020/0337412 A1 * 10/2020 Velazquez ..... A43B 3/122
2021/0153596 A1 * 5/2021 Voggenauer ..... A43B 9/00

* cited by examiner

*Primary Examiner* — Marie D Bays

(57) ABSTRACT

Heel Strap is disclosed. A shoe apparel accessory ornamental design heel strap having a V-shape, a left attachment loop opening on left extended end, a right attachment loop opening on right extended end, the left attachment loop opening and right attachment loop opening of the heel strap extending substantially horizontally from the back of the heel area to a horizontal stretch forward direction from the heel area, and outside stitching and inside stitching. In some embodiments, (1) the heel strap, front elastic band in the form of a V-shape with ends that are attached to, or formed with, the environmental clips that forms no part of the claim.

2 Claims, 1 Drawing Sheet

HEEL STRAP

DETAIL DESCRIPTION OF PREFERRED EMBODIMENT

Be it known that the Heel Strap is a new, original, and ornamental design for which the following is a specification, functionality, and with reference to the accompanying drawings forming a part thereof, in which:

A Heel Strap 1 provided with attachment loop openings 8, 10 and stitching at the ends 7, 9, 11 that helps forms and secure the attachment loop openings 8, 10. The heel strap in the shape of a V is made up of an elasticated fabric. The inner diameter of the left side piece 3 is connected to the right side piece 2 at its lower end to form a V shape 6. The top view of the heel strap left and right end is shown with environmental clips; Inform no part in claim to the attached clips as shown in FIG. 1. A triangular stitching 7 is threadedly secured on the end of the heel strap 4, 5 which allows the left side piece 3 and right side piece 2 to stay connected in the form of a V shape. In use, the left side piece 3 and right side piece 2 is made to stretch laterally back and forth (see FIG. 2) when extended freely and or attached to an environmental shoe; Inform no part in claim to the attached shoe as shown in FIG. 3.

As mentioned above, the Heel Strap can be made of elasticated member that stretches, expands, and return to its' original form after being deformed; The broken lines depicting the clips in FIG. 2 represent environment that forms no part of the claim. All other broken lines depict stitching which is included in the claim.

BRIEF DESCRIPTION OF THE DRAWINGS

Be it known that I, Patricia A. Haynes, have invented a new, original and ornamental design titled Heel Strap, for which the following is a specification, and with reference to the accompanying drawings forming a part thereof, in which.

Figure 1:
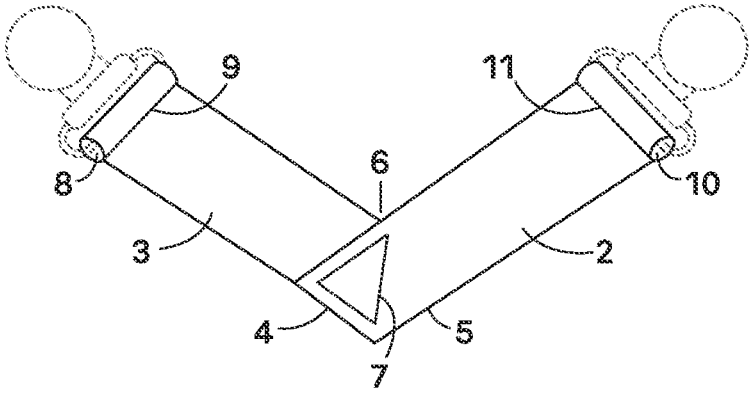
FIG. 1 is a front view of a heel strap, with clips in broken line: "Inform no part in claim to the attached clips.
Figure 2:
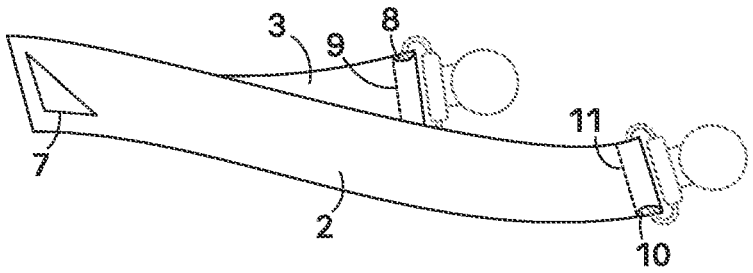
FIG. 2 is a side view of the heel strap; with clips in broken line: "Inform no part in claim to the attached clips.
Figure 3:
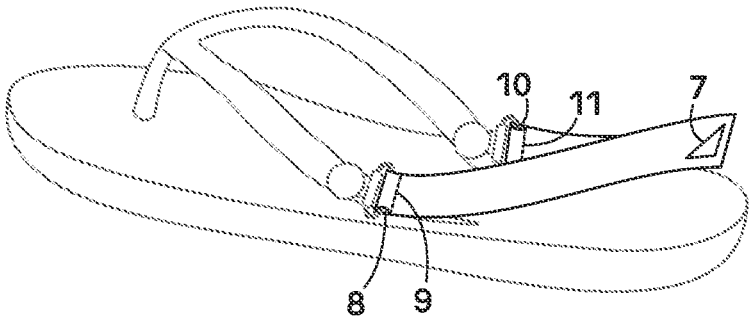
FIG. 3 is a side view illustrating one preferred embodiment of a heel strap according to the present invention with a shoe in broken lines: Inform no part of the claim to the attached clips.

I claim:

The ornamental design for a Heel Strap, as shown and described.

What is claimed is:

1. A shoe apparel accessory ornamental design heel strap formed from an elastic material comprising: a right side and a left side piece; wherein a rear end of the left side is connected to a rear end of the right side to form a V shape by stitching in a triangular shape through both ends; the heel strap comprises attachment loops on the forward ends of the right and left sides formed stitching; wherein in use the triangular shaped stitching is placed in a heel area of a shoe and the left attachment loop opening and right attachment loop opening of the heel strap extending substantially forwardly and substantially horizontally from the triangular shape stitching at different angles.

2. The shoe apparel accessory as claimed in claim 1, wherein the attachment loops include clips attached thereto.

* * * * *